US007845775B2

(12) United States Patent
Koide

(10) Patent No.: US 7,845,775 B2
(45) Date of Patent: Dec. 7, 2010

(54) INK TANK, PRINTER AND PRINTER MAIN BODY

(75) Inventor: Shohei Koide, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 1105 days.

(21) Appl. No.: 11/529,999

(22) Filed: Sep. 28, 2006

(65) Prior Publication Data

US 2007/0176983 A1 Aug. 2, 2007

(30) Foreign Application Priority Data

Sep. 28, 2005 (JP) ..... 2005-282457

(51) Int. Cl.
*B41J 2/175* (2006.01)
*B41J 2/17* (2006.01)

(52) U.S. Cl. ..... 347/85; 347/84; 347/86

(58) Field of Classification Search ..... 347/85, 347/86, 84

See application file for complete search history.

(56) References Cited

U.S. PATENT DOCUMENTS

| | | | | |
|---|---|---|---|---|
| 6,102,537 | A | 8/2000 | Kato et al. | |
| 6,179,415 | B1 * | 1/2001 | Okazaki et al. | 347/86 |
| 6,267,476 | B1 | 7/2001 | Kato et al. | |
| 6,302,530 | B1 * | 10/2001 | Shimada et al. | 347/86 |
| 6,375,308 | B1 * | 4/2002 | Shimada | 347/43 |

FOREIGN PATENT DOCUMENTS

| | | |
|---|---|---|
| JP | 8-216430 | 8/1996 |
| JP | 2004-009447 | 1/2004 |
| JP | 2008074090 A * | 4/2008 |

* cited by examiner

*Primary Examiner*—Stephen D Meier
*Assistant Examiner*—Leonard S Liang
(74) *Attorney, Agent, or Firm*—Frommer Lawrence & Haug LLP

(57) ABSTRACT

An ink tank which includes a plurality of ink chambers and a plurality of supply ports is provided. The plurality of supply ports are provided for the respective ink chambers. Each of the supply ports communicates an outside with each of the ink chambers. Ink stored in the each of the ink chambers is supplied through the each of the supply ports to the outside.

10 Claims, 5 Drawing Sheets

INK TANK, PRINTER AND PRINTER MAIN BODY

CROSS-REFERENCE TO RELATED APPLICATIONS

This application claims the benefit of Japanese Patent Application No. 2005-282467 filed Sep. 28, 2005 in the Japanese Patent Office, the disclosure of which is incorporated herein by reference.

BACKGROUND

The present invention relates to an ink tank capable of supplying ink to a printer, a printer provided with the ink tank and receiving ink supply from the ink tank, and a printer main body configured to allow attachment of the ink tank thereto.

There have been proposed a variety of techniques for performing high-speed printing in a specific color by using a plurality of ink tanks each storing an ink of the specific color in a printer capable of color printing. According to such techniques, high-speed black and white printing can be performed by, for example, setting ink tanks storing black ink instead of ink tanks storing color inks and then performing printing.

SUMMARY

However, in a case of performing high-speed printing using a specific color according to the above techniques, previously set ink tanks need to be replaced with ink tanks storing an ink of the same specific color. Accordingly, the ink tanks for high-speed printing must be prepared in addition to usually used ink tanks, which results in an extra cost of the ink tanks for high-speed printing.

For example, in a case in which four ink tanks each storing an ink of each of black, yellow, magenta and cyan are used, ink tanks storing inks of colors other than black need to be replaced with ink tanks storing black ink, in order to perform high-speed black and white printing. As a result, extra three ink tanks storing black ink must be prepared, which results in an increase in cost.

It may, therefore, be preferable to provide an ink tank that allows high-speed printing in a specific color while suppressing an increase in cost.

It may be preferable to provide an ink tank that is attachable to a printer main body in a plurality of attachment manners.

In one aspect of the present invention, there is provided an ink tank which includes a plurality of ink chambers and a plurality of supply ports. The plurality of supply ports are provided for the respective ink chambers. Each of the supply ports communicates an outside with each of the ink chambers. Ink stored in the each of the ink chambers is supplied through the each of the supply ports to the outside.

According to the ink tank of the present invention, since a plurality of sets of ink chambers and supply ports to supply ink from the ink chambers to a printer are provided, the ink tank may be attached in a plurality of attachment manners.

BRIEF DESCRIPTION OF THE DRAWINGS

A preferred embodiment of the present invention will be described hereinafter with reference to the drawings, in which.

DETAILED DESCRIPTION OF THE PREFERRED EMBODIMENT

[Overall Structure]

Figure 1A:
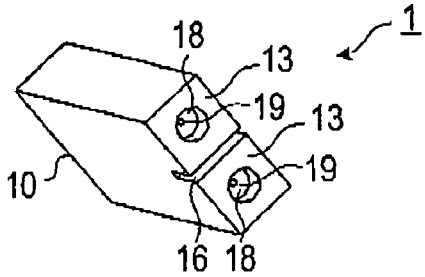
FIG. 1A is a perspective view showing a structure of an ink tank.
Figure 1C:
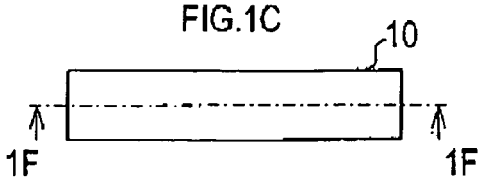
FIG. 1C is a plan view showing the structure of the ink tank.
Figure 1E:
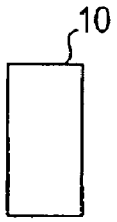
FIG. 1E is a left side elevation view showing the structure of the ink tank.

As shown in FIG. 1A to FIG. 1G, an ink tank 1 includes a substantially rectangular tank main body 10 provided with a plurality of (two in the present embodiment) ink chambers 11, each storing an ink, and a plurality of (two in the present embodiment) attachment portions 13 for attachment to a printer main body 4.

Figure 1B:
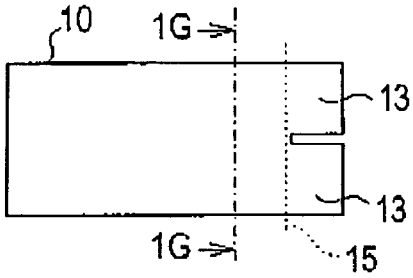
FIG. 1B is a front elevation view showing the structure of the ink tank.
Figure 1D:
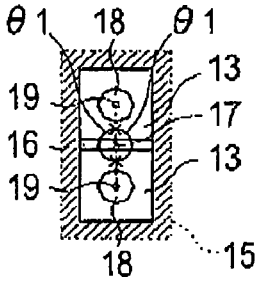
FIG. 1D is a right side elevation view showing the structure of the ink tank.
Figure 1F:
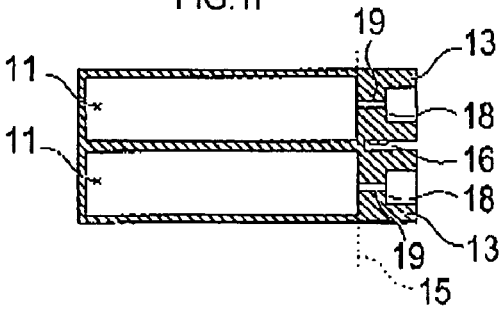
FIG. 1F is a cross-sectional view along line 1F-1F of FIG. 1C showing an internal structure of the ink tank.
Figure 1G:
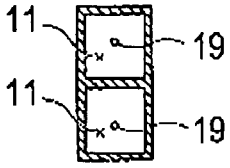
FIG. 1G is a cross-sectional view along line 1G-1G of FIG. 1B showing the internal structure of the ink tank.

The ink chambers 11 are formed as spaces extending in the same direction, i.e., in a right and left direction in FIG. 1B and FIG. 1F (see FIG. 1F). One of the ink chambers 11 stores black ink which is most frequently used, and the other of the ink chambers 11 stores a color ink of a color other than black.

Each of the attachment portions 13 is provided at one end (a right end in FIG. 1B and FIG. 1F) of each of the ink chambers 11. The each of the attachment portions 13 forms a projection having a substantially square cross section and projecting from a crossing surface 15 perpendicular to a direction in which the ink chamber 11 extends, toward an opposite side of the ink chamber 11 (a right end in FIG. 1B and FIG. 1F).

In the ink tank 1, the attachment portions 13 have a same configuration, and a recessed groove 16 with a specified width is provided between the attachment portions 13. By fitting the attachment portions 13 in a printer (i.e., aftermentioned first attachment receiving portion 21 and second attachment receiving portion 23), the ink tank 1 can be attached to the printer main body 4.

The each of the attachment portions 13 includes a supply port 19 that allows supply of the ink stored in the ink chamber 11 to the printer main body 4 when the ink tank 1 is attached to the printer main body 4 with the attachment portions 13. The supply port 19 is a through hole formed so as to penetrate from an end surface of the each of the attachment portions 13 on a side of a supply direction to the ink chamber 11. A substantially circular recess 18 is formed around the through hole.

When the ink tank 1 is seen from an ink supply direction, the supply ports 19 are spaced by equal angular intervals θ1 (180° in the present embodiment) around a center point 17 of all (two in the present embodiment) the supply ports 19, as shown in FIG. 1D.

A description will now be provided of the printer main body 4 to which the above-described ink tank 1 is attached.

Figure 2A:
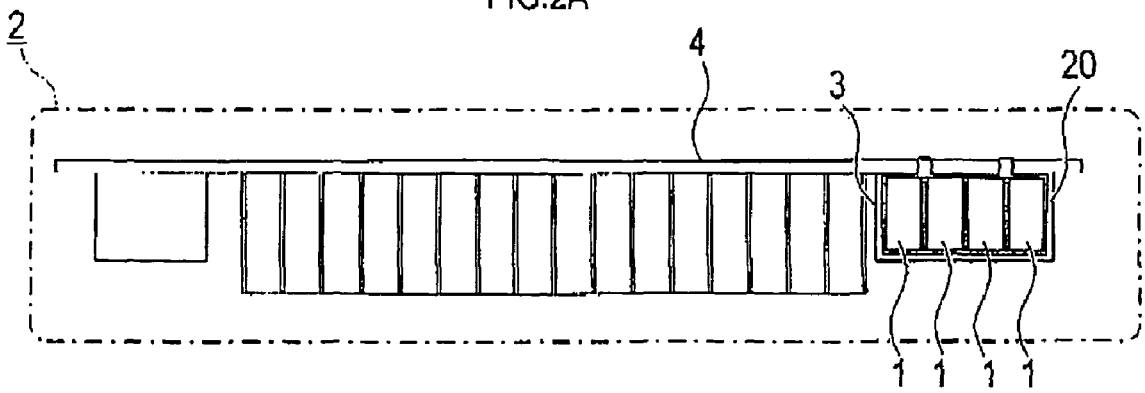
FIG. 2A is a plan view showing a structure of a printer.
Figure 2B:
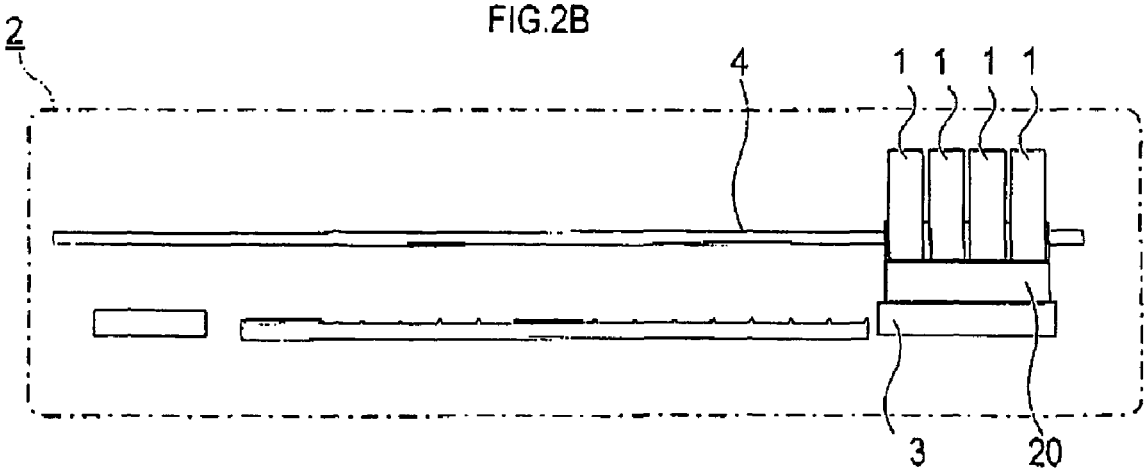
FIG. 2B is a front elevation view showing the structure of the printer.

As shown in FIG. 2A and FIG. 2B, the printer main body 4 includes a carriage 3 which is provided with an attachment receiving member 20 to receive the ink tank 1. The printer main body 4 and a plurality of ink tanks 1 attached to the attachment receiving member 20 constitute a printer 2 that receives supply of ink from the ink tanks 1 and performs recording of an image on a recording medium.

Figure 3A:
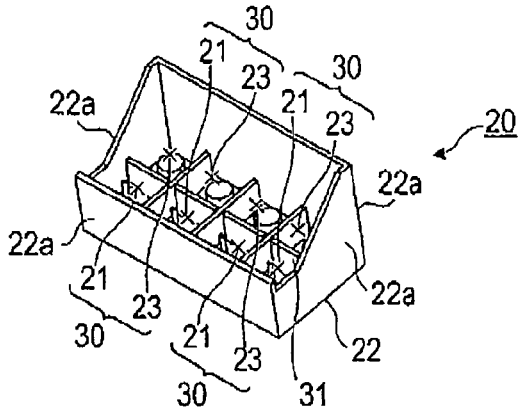
FIG. 3A is a perspective view showing a structure of an attachment receiving member.
Figure 3C:
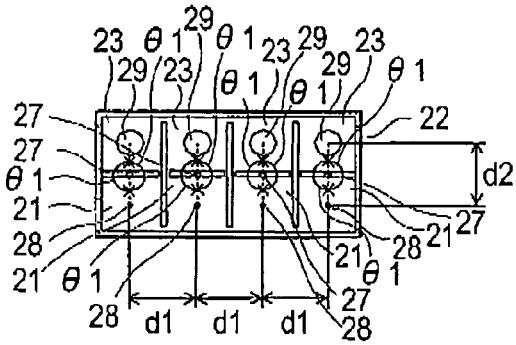
FIG. 3C is a plan view showing a positional relationship among attachment receiving portions in the attachment receiving member.
Figure 3B:
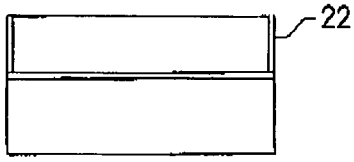
FIG. 3B is a front elevation view showing the structure of the attachment receiving member.
Figure 3D:
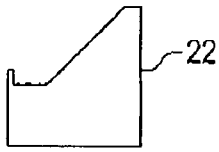
FIG. 3D is a right side elevation view showing the structure of the attachment receiving member.
Figure 3E:
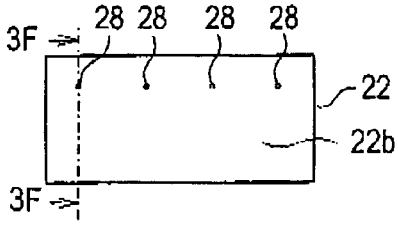
FIG. 3E is a bottom view showing the structure of the attachment receiving member.
Figure 3F:
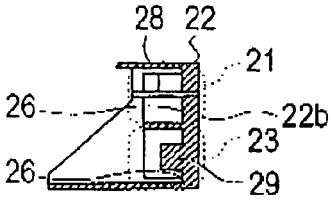
FIG. 3F is a cross-sectional view along line 3F-3F of FIG. 3E showing an internal structure of the attachment receiving member.
Figure 3G:
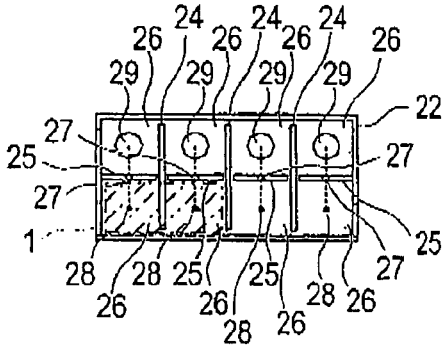
FIG. 3G is a plan view for illustrating a configuration of the attachment receiving portions in the attachment receiving member.
Figure 4A:
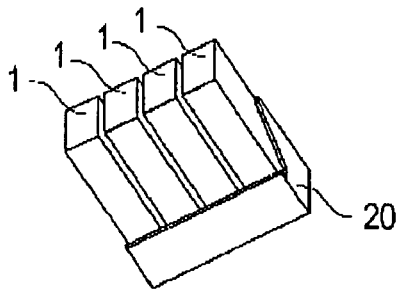
FIG. 4A is a perspective view showing a state in which the ink tanks are attached to the attachment receiving member.
Figure 4B:
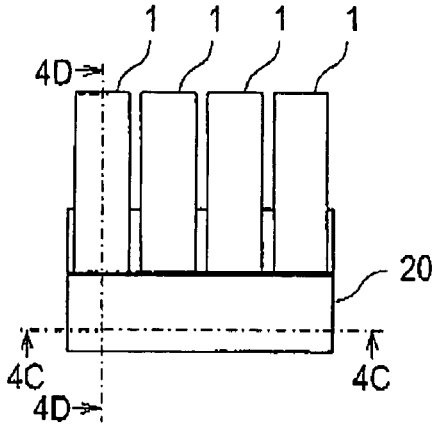
FIG. 4B is a front elevation view showing the state in which the ink tanks are attached to the attachment receiving member.
Figure 4C:
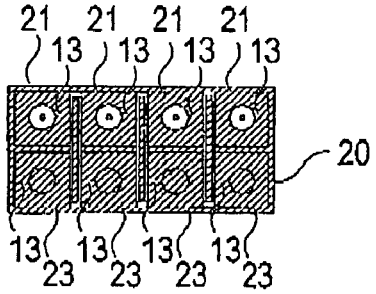
FIG. 4C is a cross-sectional view along line 4C-4C of FIG. 4B showing the state in which the ink tanks are attached to the attachment receiving member.
Figure 4D:
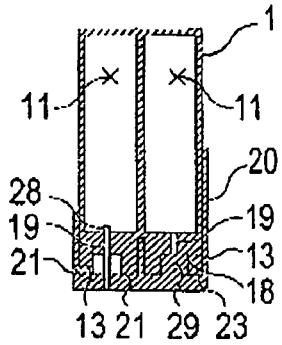
FIG. 4D is a cross-sectional view along line 4D-4D of FIG. 4B showing the state in which the ink tanks are attached to the attachment receiving member.

As shown in FIGS. 3A, 3C and 3G, the attachment receiving member 20 includes a main body 22 and a wall 31. The main body 22 is formed into a substantially rectangular box shape with one open side. The wall 31 projects from an internal bottom surface of the main body 22 so as to be perpendicular to the internal bottom surface, and divides an internal space of the box shape into a plurality of (eight in the present embodiment) spaces.

The wall 31 is formed to have a thickness and a height so as to be engageable with the recessed groove 16 between the two attachment portions 13 of the ink tank 1. The wall 31 includes three first walls 24 and four second walls 25. The first walls 24 are arranged in a shorter-side direction of the main body 22 (in an upper and lower direction in FIG. 3G) so as to divide the internal space of the box shape into four substantially identical sections, when seen in a plan view. The second walls 25 are arranged in a direction perpendicular to the first walls 24 so as to further divide each of the four identical sections into two substantially identical sub-sections.

All the sub-sections divided by the first walls 24 and the second walls 25 have substantially the same configuration, when seen in the plan view.

The first walls 24, the second walls 25 and side walls 22*a* of the main body 22 constitute a plurality of attachment receiving portions 21 and 23 formed in the attachment receiving member 20. Each of the attachment receiving portions 21 and 23 fittingly receives each of the attachment portions 13 included in the ink tank 1.

As shown in FIG. 3A and FIG. 3C, the plurality of attachment receiving portions 21 and 23 specifically include four first attachment receiving portions 21 and four second attachment receiving portions 23. The first attachment receiving portions 21 are aligned side by side along a longitudinal direction of the main body 22, and the second attachment receiving portions 28 are aligned side by side in parallel with the first attachment receiving portions 21.

In other words, a plurality of (four in the present embodiment) combinations 30 are aligned side by side along the longitudinal direction of the main body 22 in the attachment receiving member 20, as shown in FIG. 3A. Each of the combinations 30 is constituted by one first attachment receiving portion 21 and one second attachment receiving portion 23. By fitting each one of the two attachment portions 13 of the ink tank 1 into the one first attachment receiving portion 21 and the one second attachment receiving portion 23, the ink tank 1 is attached to the attachment receiving member 20.

Each of the first attachment receiving portions 21 and the second attachment receiving portions 23 is formed to have a concave configuration with a substantially square internal bottom surface 26.

Each of the first attachment receiving portions 21 is provided with an introduction pipe 28 which penetrates from a center of the internal bottom surface 26 to an external bottom surface 22*b* of the main body 22, as shown in FIG. 3E to FIG. 3G. When the attachment portion 13 of the ink tank 1 is fitted in the first attachment receiving portion 21, the introduction pipe 28 and the supply port 19 of the attachment portion 13 constitute an ink flow path from the ink tank 1. Thus, introduction of ink into the printer main body 4 becomes possible through the supply port 19 of the ink tank 1 and the introduction pipe 28 when the ink tank 1 is attached.

When one of the two attachment portions 13 of the ink tank 1 is fitted in the first attachment receiving portion 21, the other one of the two attachment portions 13 is fitted in the second attachment receiving portion 23. As shown in FIG. 3F and FIG. 3G, a cylindrical closing portion 29 made of an elastic member is provided in a central part of the internal bottom surface 26 of the second attachment receiving portion 23. When the attachment portion 13 is fitted in the second attachment receiving portion 23, the closing portion 29 contacts around the supply port 19 in a pressed manner, and thereby closes the supply port 19.

The first attachment receiving portion 21 and the second attachment receiving portions 23 in a single combination 30, and thus the introduction pipe 28 and the closing portion 29 in a single combination 30 are arranged, when seen from a direction perpendicular to the internal bottom surface 26 as shown in FIG. 3A and FIG. 3C, so as to be spaced by equal angular intervals θ1 (180° in the present embodiment) around the center point 27 of the introduction pipe 28 and the closing portion 29 in the single combination 30.

Also, as shown in FIG. 3C, a distance d1 between center points of each two neighboring first attachment receiving portions 21 (i.e., a distance d1 between each two neighboring introduction pipes 28) is configured to be equal to a distance d2 between a center point of the first attachment receiving portion 21 and a center point of the second attachment receiving portion 23 in each single combination 30 (i.e., a distance d2 between the introduction pipe 28 and the closing portion 29).

When four ink tanks 1 are attached to the attachment receiving member 20 of the printer main body 4 configured as above, the attachment portions 13 of the ink tanks 1 are respectively fitted in the four combinations 30 (each constituted by one first attachment receiving portions 21 and one second attachment receiving portions 23) provided in the attachment receiving member 20, as shown in FIG. 4A to FIG. 4D. Then, the introduction pipe 28 provided in the first attachment receiving portion 21 reaches an inside of the ink chamber 11 through the supply port 19 formed in the attachment portion 13 of the ink tank 1 (see FIG. 4D).

At the same time, the closing portion 29 provided in the second attachment receiving portion 23 is fitted in the recess 18 formed in the attachment portion 13 of the ink tank 1. Then, the closing portion 29 is pressed around the supply port 19 and thereby closes the supply port 19 (see FIG. 4D).

[Operation and Advantages]

The above-described ink tank 1 includes a plurality of (two in the present embodiment) sets of the ink chambers 11, the supply ports 19 for supplying ink from the ink chambers 11 to an outside, and the attachment portions 13 provided with the supply ports 19. Accordingly, the ink tank 1 may be attached to the attachment receiving member 20 provided in the printer main body 4 in a plurality of attachment manners.

Also, each of the attachment portions 13 projects from one end of the ink chamber 11 in the same configuration, and each of the supply ports 19 is oriented in the same direction in the ink tank 1 of the present embodiment. Accordingly, the attachment portion 13 fitted in the first attachment receiving portion 21 can easily be switched with the other attachment portion 13 provided in the same ink tank 1 while keeping the attachment portions 13 oriented in the same direction. Then, the supply ports 19 to supply ink to the printer main body 4 can easily be switched with each other.

Further, when the ink tank 1 is seen from the ink supply direction, the supply ports 19 are spaced by equal angular intervals θ1 (180° in the present embodiment) around the center point 17 of a plurality of (two in the present embodiment) supply ports 19 in the ink tank 1. Accordingly, by rotating the ink tank 1 around a center axis, which is parallel with the ink supply direction and passes through the center point 17, by an equal angle θ1, the supply ports 19 to supply ink to the printer main body 4 can be switched with each other.

Specifically, since the angular interval θ1 of the two supply ports 19, i.e., the center points of the two attachment portion 13, is 180° in the present embodiment, the attachment portion 13 fitted in the first attachment receiving portion 21 may be switched with the other attachment portion 13 by rotating the ink tank 1 by 180° around the center axis. Then, the other attachment portion 13 may in turn be easily fitted in the attachment receiving portion 21.

In the ink tank 1 of the present embodiment, black ink is stored in one of the two ink chambers 11, while a color ink of a color other than black is stored in the other ink chamber 11. That is, inks of two different colors are stored in the two ink chambers 11. Accordingly, when the attachment portion 13 projecting from the end of the ink chamber 11 storing black ink is fitted in the first attachment receiving portion 21, black and white printing is possible, while the other attachment portion 13 (i.e., the attachment portion 13 projecting from the end of the ink chamber 11 storing the color ink) is fitted in the first attachment receiving portion 21, color printing is possible. Thus, one of the inks of two different colors may be supplied to the printer main body 4 depending on an orientation of attachment of the ink tank 1 to the attachment receiving member 20, according to the ink tank 1 of the present embodiment.

The attachment receiving member 20 of the printer main body 4 of the present embodiment includes the combination 30 constituted by one first attachment receiving portion 21 and one second attachment receiving portion 23, while the ink tank 1 includes two attachment portions 13. By fitting the respective attachment portions 13 in the first attachment receiving portion 21 and the second attachment receiving portion 23, the ink tank 1 may be attached to the printer main body 4. Since a plurality of combinations 30 are aligned side by side in the attachment receiving member 20, a plurality of ink tanks 1 may be attached to the printer main body 4.

In the printer main body 4 of the present embodiment, the second attachment receiving portion 23 is provided with the cylindrical closing portion 29, while the end surface of the each of the attachment portions 13 of the ink tank 1 is provided with the circular recess 18. Accordingly, when the ink tank 1 is attached to the attachment receiving member 20, the attachment portion 13 of the ink tank 1, which is not fitted in the first attachment receiving portion 21, is fitted in the second attachment receiving portion 23. Then, the closing portion 29 is fitted in the recess 18, and thereby closes the supply port 19 of the attachment portion 13.

Thus, the closing portion 29 of the second attachment receiving portion 23 may close the supply port 19 of the ink tank 1, which should not supply ink to the printer main body 4. This may prevent a contact of the supply port 19 with the atmosphere.

When the supply port 19 of the attachment portion 13 is exposed to the atmosphere, a region of the supply port 19 will be dried up and a viscosity of the ink stored in the ink chamber 11 will be increased. Since this may obstruct a subsequent supply of ink, exposure of the supply port 19 to the atmosphere is undesirable.

According to the above-described configuration, exposure of the supply port 19 to the atmosphere may be avoided by closing the supply port 19 of the attachment portion 13 of the ink tank 1, which is not fitted in the first attachment receiving portion 21 of the printer main body 4, with the closing portion 29 of the second attachment receiving portion 23. It may, therefore, be possible to suppress an increase in viscosity of the ink stored in the ink chamber 11 due to a dryness of the region of the supply port 19.

According to the above-described configuration, when the ink tank 1 is attached to the printer main body 4, the closing portion 29 made of the elastic member is pressed around the supply port 19 of the attachment portion 13, and thereby closes the supply port 19.

In the attachment receiving member 20 of the printer main body 4, the first attachment receiving portion 21 and the second attachment receiving portion 23 in the single combination 30 are arranged as follows, when seen from a direction perpendicular to the inner bottom surface 26. That is, the introduction pipe 28 and the closing portion 29 in the single combination 30 are arranged by equal angular intervals θ1 (180° in the present embodiment) around the center point 27 of the introduction pipe 28 and the closing portion 29 in the single combination 30.

Accordingly, by rotating the ink tank 1 around the center axis, which is perpendicular to the inner bottom surface 26 and passes through the center point 27, by an equal angle, a supply port to supply ink to the printer main body 4 may easily be switched from one of the supply ports 19 with the other one of the supply ports 19.

Specifically, the angular interval θ1 is 180° in the present embodiment. Therefore, the attachment portion 13 fitted in the first attachment receiving portion 21 may be fitted instead in the second attachment receiving portion 23 in the single combination 30, by rotating the ink tank 1 by 180° around the center axis. Then, the attachment portion 13 fitted in the second attachment receiving portion 23 may be fitted instead in the first attachment receiving portion 21 in the same single combination 30. That is, the attachment portion 13 to be fitted in the first attachment receiving portion 21 may be switched easily.

In this case, it is not necessary to replace the ink tank 1 itself but is only necessary to switch the attachment portion 13 to be fitted in the first attachment receiving portion 21 of the printer main body 4. Accordingly, it may be unnecessary to prepare an extra ink tank, which may prevent an increase in cost for the extra ink tank.

Further, an ink of the same color (black ink in the present embodiment) is stored in one of the two ink chambers 11 provided in each of the plurality of ink tanks 1. Accordingly, the ink of the same color may be supplied from the each of the plurality of ink tanks 1 to the printer main body 4 by attaching the attachment portion 13, which projects from the ink chamber 11 storing the ink of the same color, of the each of the plurality of ink tanks 1 to the first attachment receiving portion 21 in each of the combinations 30 provided in the attachment receiving member 20. Thus, high-speed printing in the same color (in black color in the present embodiment) may be achieved.

To achieve high-speed printing, it is necessary to make the printer 2 (the printer main body 4) recognize that the color of ink to be supplied from the ink tank I has been changed. This may be performed by employing a known conventional technique or by adding an operation to change settings at the printer main body 4.

[Modification]

Although one embodiment of the present invention has been described as above, the present invention should not be limited to the above-described embodiment, but may be embodied in various forms within the scope of the present invention.

For example, in the attachment receiving member 20 of the above-described embodiment, the introduction pipes 28 in the respective combinations 30 are aligned side by side to neighbor one another such that the distance d1 between the introduction pipes 28 in each two neighboring combinations 30 is configured to be equal to the distance d2 between the introduction pipe 28 and the closing portion 29 in each single combination 30. Accordingly, the ink tank 1 may be attached to the attachment receiving member 20 such that both of the two attachment portions 13 provided in the ink tank 1 are fitted in the first attachment receiving portions 21.

Specifically, the ink tank 1 may be attached to the attachment receiving member 20, for example, in a manner shown by the plan view of the attachment receiving member 20 in FIG. 3G (the ink tank 1 indicated by a two-dot chain line). In this case, the ink may be supplied from the ink tank 1 through the two supply ports 19 provided in the ink tank 1 to the two introduction pipes 28, and then through the two introduction pipes 28 to the printer main body 4.

Inks of two different colors are stored in the two ink chambers 11 in the ink tank 1 of the above-described embodiment. However, inks of the same color may be stored in the two ink chambers 11 and the ink tank 1 is attached to the attachment receiving member 20 such that both of the two attachment portions 13 are fitted in the first attachment receiving portions 21. Then, the ink of the same color may be supplied through the two supply ports 19 provided in the ink tank 1 to the introduction pipes 28, and thereby high-speed printing with the ink of the same color stored in the ink chambers 11 may be achieved. In a case where black ink is stored in both of the two chambers 11, high-speed printing in black may be performed with the single ink tank 1.

In the above-described embodiment, the configuration of the present invention is applied, by way of example, to a printer including the carriage 3 provided with the attachment receiving member 20. However, the configuration of the present invention may be applied not only to a printer including a carriage provided with the attachment receiving member 20, but to any type of printer configured to supply ink from an ink tank to a recording head. For example, the configuration may be applied to a printer provided with the attachment receiving member 20 located in a position apart from a carriage.

In the above-described embodiment, the attachment receiving member 20 is configured, by way of example, to accept attachment of four ink tanks 1. However, the number of ink tanks 1 acceptable by the attachment receiving member 20 is not limited to four. For example, in a printer 2 which may accept attachment of five or more ink tanks 1 and perform color printing in five or more colors (specifically, for example, seven colors of black, yellow, magenta, cyan, light cyan, light magenta and photo blue), inks of black and one of the five or more colors may be stored in each of the ink tanks 1.

According to this configuration, high-speed printing in black as well as high-resolution color printing in five or more colors may be achieved. In this case, as the number of the ink tanks 1 attached so as to supply black ink becomes increased, an amount of black ink to be supplied to the printer main body 4 becomes increased. Thus, a further enhanced high-speed printing in black may be achieved.

In the above-described embodiment, the ink tank 1 is provided with two attachment portions 13, and the printer main body 4 (the attachment receiving member 20) is provided with one first attachment receiving portion 21 and one second attachment receiving portion 23. A total number of the first attachment receiving portion(s) 21 and the second attachment receiving portion(s) 23 in a single combination 30 is two. However, the total number may be three or more. The ink tank 1 may be provided with three or more attachment portions 13.

For example, FIG. 5A to FIG. 5E show an ink tank 40 provided with four attachment portions 43. The ink tank 40 includes a substantially rectangular tank main body 41 provided with four sets of ink chambers, supply ports 49 and attachment portions 43. Each of the ink chambers is formed in a same manner as in the above-described embodiment. The supply ports 49 designed to supply ink to an outside are formed in the attachment portions 43, respectively.

Figure 5A:
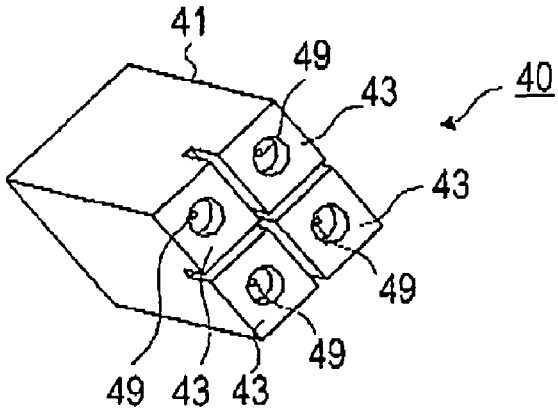
FIG. 5A is a perspective view showing a structure of an ink tank in a modification.
Figure 5C:
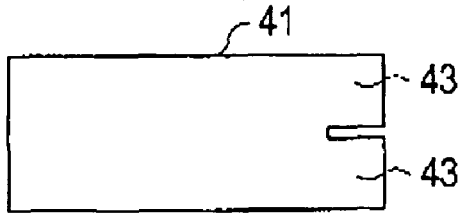
FIG. 5C is a plan view showing the structure of the ink tank in the modification.
Figure 5E:
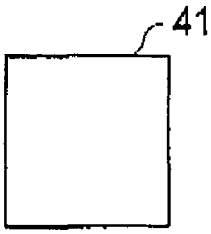
FIG. 5E is a left side elevation view showing the structure of the ink tank in the modification.
Figure 5B:
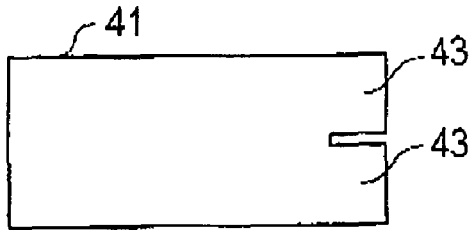
FIG. 5B is a front elevation view showing the structure of the ink tank in the modification.
Figure 5D:
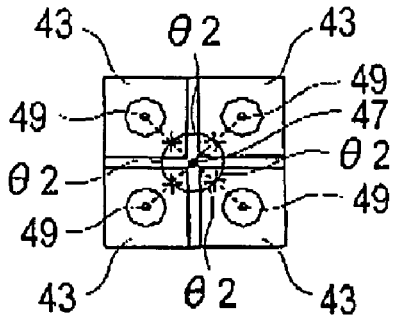
FIG. 5D is a right side elevation view showing the structure of the ink tank in the modification.

When the ink tank 40 is seen from an ink supply direction, the supply ports 49 are spaced by equal angular intervals θ2 (i.e., 90°) around a center point 47 of four of the supply ports 49, as shown in FIG. 5D.

In the attachment receiving member 20 of the above-described embodiment, the introduction pipes 28 in the respective combinations 30 are aligned side by side to neighbor one another such that the distance d1 between the introduction pipes 28 in each two neighboring combinations 30 is configured to be equal to the distance d2 between the introduction pipe 28 and the closing portion 29 in each single combination 30. Accordingly, the ink tank 40 may be attached to the attachment receiving member 20 by fitting two of the attachment portions 43 in two neighboring first attachment receiving portions 21 and fitting the other two of the attachment portions 43 in two neighboring second attachment receiving portions 23.

It is, therefore, possible to easily fit another attachment portion 43 in each of the first attachment receiving portions 21 by rotating the ink tank 40 by 90° around a center axis, which is parallel with the ink supply direction and passes through the center point 47, according to the ink tank 40 configured as above.

In the ink tank 1 of the above-described embodiment, at least one of the ink chambers 11 stores the ink of the color which is most frequently used, and the other ink chamber 11 stores the ink of the color other than the most frequently used color. However, a combination of the colors is not limited to any specific one in the case where the ink chambers 11 store inks of different colors, respectively.

In the above-described embodiment, at least one of the ink chambers 11 in the ink tank 1 stores black ink as the ink of the color which is most frequently used. However, the color which is most frequently used may be any other color in which printing is frequently performed.

In the above-described embodiment, the second attachment receiving portion 23 is configured such that the closing portion 29 made of an elastic member is pressed around the supply port 19 in the attachment portion 13, and thereby closes the supply port 19. However, a configuration to close the supply port 19 by the second attachment receiving portion 23 is not limited to any specific one.

Since the second attachment receiving portion 23 is configured to be fitted around the attachment portion 13 so as to cover the supply port 19 formed in the attachment portion 13, the supply port 19 is unlikely to be exposed to the atmosphere once the attachment portion 13 is fitted therein. Accordingly, it may be possible, for example, to provide no closing portion 29 and close the supply port 19 only by fitting the second attachment receiving portion 23 having a concave shape around the attachment portion 13.

What is claimed is:

1. A printer, comprising:

at least one ink tank including:

a plurality of ink chambers; and a plurality of supply ports provided for the respective ink chambers, each of the supply ports communicating an outside with each of the ink chambers;

wherein ink stored in the each of the ink chambers is supplied through the each of the supply ports to the outside; and an attachment receiving unit capable of receiving the at least one ink tank;

wherein ink is supplied from the at least one ink tank through the attachment receiving unit;

wherein the plurality of ink chambers includes a first ink chamber and a second ink chamber;

wherein the plurality of supply ports includes a first supply port for the first ink chamber, and a second supply port for the second ink chamber;

wherein the attachment receiving unit includes at least one combination provided with:

at least one introduction port to which ink is supplied through the first supply port when the at least one ink tank is attached to the attachment receiving unit in either a first state, in which the first and second ink chambers are arranged in the attachment receiving unit along a specified direction, or a second state, in which the first and second ink chambers are arranged in the attachment receiving unit along a direction perpendicular to the specified direction specified direction; and at least one closing portion that closes the second supply port not to supply ink to the printer when the at least one ink tank is attached to the attachment receiving unit in the second state;

wherein, in the first state in which the first and second ink chambers are arranged in the attachment receiving unit along the specified direction, the first supply port communicates the first ink chamber with an outside of the first ink chamber via the at least one introduction port of the attachment receiving unit, and the second supply port communicates the second ink chamber with an outside of the second ink chamber at least one other introduction port of the attachment receiving unit; and wherein, in the second state of the ink tank in which the first and second ink chambers are arranged in the attachment receiving unit along the direction perpendicular to the specified direction specified direction, the first supply port communicates the first ink chamber with an outside of the first ink chamber via the at least one introduction port of the attachment receiving unit, and the second supply port is closed by the at least one closing portion of the attachment receiving unit.

2. The printer according to claim 1;

wherein all introduction ports and closing portions provided to at least one specific combination of the at least one combination are provided in a same direction; and wherein the all introduction ports and closing portions provided to the at least one specific combination are spaced by equal angular intervals around a center point of the all introduction ports and closing portions.

3. The printer according to claim 2;

wherein the at least one combination is at least two combinations;

wherein the attachment receiving unit includes the at least two combinations;

wherein each of the at least two combinations includes one of the introduction ports and one of the closing portions;

wherein, in the at least two combinations, the introduction ports provided to the respective combinations are aligned side by side one another; and wherein a distance between each neighboring two of the introduction ports is equal to a distance between the introduction port and the closing portion provided to each of the at least two combinations.

4. The printer according to claim 3;

wherein, in the ink tank including the two ink chambers, ink of a same color is stored in both of the two ink chambers.

5. The printer according to claim 4;

wherein the ink of the same color is black ink.

6. The printer according to claim 1;

wherein the at least one ink tank according to claim 1 is a plurality of ink tanks according to claim 1;

wherein the at least one combination is a plurality of combinations;

wherein the attachment receiving unit includes the plurality of combinations, each provided with the at least one introduction port and the at least one closing portion; and wherein each of the plurality of ink tanks includes a number of the supply ports equal to a total number of the at least one introduction port and the at least one closing portion provided to each of the combinations.

7. The printer according to claim 6;

wherein ink of a same color is stored in at least one of the ink chambers provided to each of at least two ink tanks of the plurality of ink tanks.

8. The printer according to claim 7;

wherein the ink of the same color is black ink.

9. The printer according to claim 7;

wherein each of the ink tanks includes a plurality of attachment portions provided for the respective ink chambers;

wherein each of the attachment portions projects from the each of the ink chambers in an ink supply direction;

wherein the attachment receiving unit includes a plurality of concavely shaped attachment receiving portions, each capable of fittingly receiving the each of the attachment portions; and wherein one of the introduction port and the closing portion is provided in an inner bottom part of each of the concavely shaped attachment receiving portions.

10. The printer according to claim 9;

wherein the each of the ink tanks includes:

a plurality of through holes as the supply ports, each formed so as to penetrate through the each of the attachment portions; and a plurality of recesses, each formed around the each of the through holes in an end surface of the each of the attachment portions on a side of the ink supply direction; and wherein the at least one closing portion included in each of the combinations includes a convex portion capable of being fitted in each of the recesses.

* * * * *